US008835888B2

(12) United States Patent
Keegan et al.

(10) Patent No.: US 8,835,888 B2
(45) Date of Patent: Sep. 16, 2014

(54) INTEGRATED POD OPTICAL BENCH DESIGN

(75) Inventors: Heather L. Keegan, Goffstown, NH (US); Robert C. Guyer, Beverly, MA (US); William T. Fielder, Boston, MA (US); Donald K. Smith, Rye, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 341 days.

(21) Appl. No.: 13/486,445

(22) Filed: Jun. 1, 2012

(65) Prior Publication Data

US 2012/0243570 A1 Sep. 27, 2012

Related U.S. Application Data

(62) Division of application No. 12/228,032, filed on Aug. 8, 2008, now Pat. No. 8,217,375.

(60) Provisional application No. 61/010,257, filed on Jan. 7, 2008.

(51) Int. Cl.

| | |
|---|---|
| ***H01S 3/00*** | (2006.01) |
| ***F41H 13/00*** | (2006.01) |
| ***F41J 2/02*** | (2006.01) |
| ***F41H 11/02*** | (2006.01) |
| ***F41G 7/22*** | (2006.01) |

(52) U.S. Cl.

CPC ..... *F41H 11/02* (2013.01); *F41H 13/005* (2013.01); *F41J 2/02* (2013.01); *F41G 7/224* (2013.01)

USPC ..... 250/522.1; 250/526; 250/504 R; 250/493.1

(58) Field of Classification Search

None

See application file for complete search history.

(56) References Cited

U.S. PATENT DOCUMENTS

| | | | | |
|---|---|---|---|---|
| 4,106,740 | A | 8/1978 | Lloyd et al. | |
| 4,283,688 | A * | 8/1981 | Lloyd et al. | 372/107 |
| 4,798,462 | A * | 1/1989 | Byren | 356/139.08 |
| 4,812,639 | A * | 3/1989 | Byren et al. | 250/201.1 |
| 4,853,528 | A * | 8/1989 | Byren et al. | 250/201.9 |
| 5,672,872 | A * | 9/1997 | Wu et al. | 250/330 |
| 5,902,996 | A | 5/1999 | Sauter | |
| 6,020,955 | A * | 2/2000 | Messina | 356/138 |
| 6,072,572 | A * | 6/2000 | Hatfield et al. | 356/152.3 |
| 6,196,514 | B1 * | 3/2001 | Kienholz | 248/550 |
| 6,288,381 | B1 * | 9/2001 | Messina | 250/201.1 |
| 6,737,664 | B2 * | 5/2004 | Shaffer et al. | 250/559.3 |
| 6,754,013 | B2 | 6/2004 | Willis | |
| 6,781,773 | B2 * | 8/2004 | Willis | 359/831 |
| 7,414,241 | B2 | 8/2008 | Scott et al. | |
| 7,496,241 | B1 | 2/2009 | Reneker et al. | |
| 7,832,643 | B2 * | 11/2010 | Tsikos et al. | 235/462.25 |
| 2003/0035209 | A1 * | 2/2003 | Willis | 359/399 |
| 2003/0035229 | A1 * | 2/2003 | Willis | 359/819 |
| 2004/0041108 | A1 | 3/2004 | Shaffer et al. | |
| 2005/0029394 | A1 | 2/2005 | Ackleson et al. | |
| 2005/0065668 | A1 | 3/2005 | Sanghera et al. | |
| 2005/0201711 | A1 * | 9/2005 | Koh et al. | 385/137 |

(Continued)

*Primary Examiner* — Andrew Smyth

(74) *Attorney, Agent, or Firm* — Daniel J. Long

(57) ABSTRACT

In an integrated gimbal and High-Powered Multiband Laser (HPMBL) for use in an infrared countermeasure apparatus in a pod mounted on an aircraft, the improvement comprises an optical bench that connects the optical path between side-by-side mounted gimbal and high power laser; and a kinematic mounting system that prevents optical bench bending.

7 Claims, 5 Drawing Sheets

(56) References Cited * cited by examiner

U.S. PATENT DOCUMENTS

| | | | | |
|---|---|---|---|---|
| 2005/0218259 | A1 | 10/2005 | Kamon | |
| 2007/0075182 | A1 * | 4/2007 | Fetterly | 244/3.16 |
| 2007/0075237 | A1 * | 4/2007 | Mills et al. | 250/239 |
| 2007/0121688 | A1 * | 5/2007 | Ullman et al. | 372/34 |

INTEGRATED POD OPTICAL BENCH DESIGN

RELATED APPLICATIONS

This Application is a divisional of U.S. application Ser. No. 12/228,032 filed Aug. 8, 2008 and claims rights under 35 USC §119(e) from U.S. Application Ser. No. 61/010,257 filed Jan. 7, 2008, the contents of which are incorporated herein by reference.

STATEMENT OF GOVERNMENT INTEREST

This invention was made with United States Government assistance under Contract No. HSSCHQ-04-C-00342 awarded by the Department of Homeland Security. The United States Government has certain rights in this invention.

FIELD OF THE INVENTION

This invention relates to pod optical benches and more particularly to an integrated pod optical bench for use in mounting a laser and a directed IR countermeasure head in a counter-MANPADS application.

BACKGROUND

MANPADS are shoulder-fired infrared (IR) guided missiles for use against low flying aircraft. Many experts in the counterterrorism field believe that MANPADS may pose a danger to commercial airliners. Consequently, extensive efforts have between made to develop countermeasures to these weapons which are known as counter-MANPADS.

Such efforts have included adapting existing infrared countermeasure (IRCM) technologies for use in counter-MANPADS. For example, both gimbals and High-Powered Multi-band Lasers (HPMBLs) are known in the art. Both prior gimbals and HPMBLs have known optical paths. A need, therefore, exists for a way to integrate a gimbal and an HPMPL optical path in a limited space such as in a pod to be mounted on an aircraft.

More particularly, it is desirable to be able to mount counter-MANPAD apparatus on a commercial airliner without having to intrude into the interior space of the aircraft. In order to do this, it has been suggested that a pod be mounted to the belly of the aircraft carrying the infrared countermeasure equipment. However, a pod carrying the entire system would be canoe-shaped and at least as long as a canoe. This is not desirable, both because of its massive size and because of the air flow problems that it causes; but more importantly because in order to maintain the equipment, the entire pod must be removed from the aircraft which is a time-consuming project.

It has been proposed that many of the elements of the infrared countermeasure system be distributed throughout the aircraft. However, the two elements that are critical for the countermeasure system are the high-powered laser and the directed infrared countermeasure, (DIRCM) head; and these elements must be co-located.

It is exceedingly important to manage the optical path between the laser and the DIRCM so as to maintain strict optical alignment for avoiding microradian errors in the directivity of the laser beam from the DIRCM head towards the target.

It is therefore important to mount the laser and the directed IR countermeasure head so that the optical path is maintained. In order to do this, an optical bench is utilized to mount the laser adjacent to the head.

The problem in a lateral mounting, which is desirable to minimize intrusion into the belly of the aircraft as would be the case when a laser is mounted on top of the head, is that side-by-side mounting requires an optical bench. As has been discovered, the optical bench warps during thermal loading due to the rigid mounting schemes used.

In an effort to minimize warping, heavy optical benches have been proposed, but the weight alone is enough to make this approach undesirable.

Also, even with the largest or most robust of the optical benches, warping still occurs which disturbs the original alignment between the laser and the head. Since the head and the laser are separate and are connected using an optical bench which has an integral optical path therein, warping of the bench causes laser aiming problems.

Thus, there is a requirement for the mounting of the optical bench to the airframe that thermal effects be minimized so that warping is not a problem.

Another problem is the replacement of the laser or the head while still maintaining the original alignment. One would like to be able to achieve interchangeability of the units without having to go through a realignment process. It is thus desirable to be able to install alignment features into the setup so that one could drop a new unit onto the optical bench and maintain the original alignment.

Typically, one does not want to have to replace the entire laser/directed IR countermeasure head assembly, especially if the optical bench is bolted to the frame of the aircraft. Moreover, it is very important that the mounting of the two components to the optical bench be repeatable.

As will be appreciated, when trying to mount a laser and a head side by side, the optical bench may be 48" long by 12" wide. The length of the optical bench is determined by the desire to have a low profile so that when the optical bench is mounted in a pod and the components are mounted side by side, the pod is unobtrusive when bolted to the belly of the aircraft.

As mentioned hereinbefore, one of the key aspects of the optical bench is that one needs to have some means of preventing flexing of the optical bench and the resulting misdirection of the laser beam. It was found that a rigid mounting of the optical bench to the airframe engendered warpage of the optical bench during thermal cycling.

SUMMARY OF INVENTION

According to the present invention, a strong back optical bench is used to construct the optical path between the gimbaled directed infrared countermeasure (DIRCM) and the head high power multi-band laser. This bench is designed to be very stiff to meet a very precise optical alignment requirement (<500 μrad). As part of the bench a light pipe formed in the optical bench is used with two 45-degree mirrors on either end to establish the optical path between laser and head. The pipe is sealed to protect the optical path from debris and damage.

How optical bench warpage and flexure is avoided is now described. Rather than rigidly mounting the optical bench to the frame of the aircraft, a kinematic-style mounting is utilized in which one has a stiff but flexible mount at one end of the bench, with two rigid mounts at the other end of the bench. This three-point mounting system prevents the bench from warping and bowing during thermal cycling due to the flexing of the third point. Thus, in one embodiment, the kinematics mount is a three-point mount in which one has two rigid bolts at one end of the optical bench and a third mount that is intentionally designed with more flexibility than if one had a rigid bolted connection. Note that the stiff but flexible mount is designed to be weaker than the bench itself so that during thermal cycling, the mount flexes rather than the bench, thus keeping the bench flat by not inducing flex to the bench.

In one embodiment, the bench is mounted by the above-mentioned three-point mount to the frame of the aircraft and is made of 6061 aluminum.

As a result of the three-point mounting with one stiff but flexible coupling, any thermal expansion of the bench via-a-vis the airframe due to different coefficients of thermal expansion will not be taken up by the bench, but rather by the flexure of the stiff but flexible coupling. The result is that the thermal stress will not induce either standard or bending loads into the platform. This means that standard loading on the fixed bolts is minimized, as well as flexural loading of the bench, which would impact the aiming accuracy of the laser beam emitted by the IR countermeasure system.

The subject mounting scheme and alignment features allow for repeatability unit to unit so that the design can incorporate two line-replaceable units, namely the laser and the DIRCM head. These are bolted to the bench and are interconnected through a fixed optical path, with the units being interchangeable such that if one or the other fails, one is able to remove and replace it. One can do this without realigning the entire system so that all one has to do is make the mechanical and electrical connections to the two units.

Once having mounted the optical bench in the above manner to the air frame, the individual components are aligned through alignment pins and alignment features which in one embodiment involve having a pin and a bushing combination. Note that the pins and bushings need to be precisely located to maintain alignment.

In one embodiment, the laser beam is emitted from the laser in a direction perpendicular to the flat plane of the optical bench where it enters the optical bench in a channel and is re-directed at a right angle towards the head. When the beam reaches a position underneath the head, it is re-directed up through the bench into the directed infrared countermeasure head. Thus, the optical channel is provided with optics at either end to re-direct the light at right angles.

The stiff but flexible mount is strong enough to work structurally under all applied loads, but flexible enough so that it does not induce optical bench bending. In one embodiment, the stiff-flexible mount is made of a metal oval which flexes with thermal loading so that the oval bends and distorts as opposed to the optical bench. Thus, the stiff-flexible mount is the weak link in the system such that, while flexing, the mount is still strong enough to carry all of the applied loads.

Because of the three-point kinematic suspension which is the subject of the present invention, the bench avoids warping during thermal loading, thereby to eliminate very small microradian deflections, such that optical bench flexing of tenths of thousands of inches is avoided. Note that the optical bench design is limited by the distortion of the optical path that is tolerable, and is not governed by the structural survival of applied environmental loads.

Thus, the purpose of the subject invention is to provide an optical bench that is stiff enough to maintain the optical path and uses a stiff-flexible mount which slightly deflects to accommodate differential expansion between the airframe and the optical bench.

As will be appreciated, a very very small deflection of the optical bench, if allowed, would be multiplied by the optics involved, meaning that very small deflections are to be scrupulously avoided. It will thus be appreciated that if the optical bench is at all deflected, the beam-bending results in a laser aiming error which is multiplicative due to the optics.

The result of the ability to side-by-side mount the laser and head means minimal penetration into the airframe and results in an overall outside height which does not significantly add to drag. The apparatus mounted on the optical bench is shrouded in an external pod that is conformal to the aircraft structure, thus to provide the subject integrated pod optical bench design.

The goal to provide the minimum penetration to the platform and minimum structural modification is achieved through the side-by-side mounting system made possible through the rigid optical bench and its kinematic mount. The subject system therefore provides a low-impact way to install an infrared countermeasure system to commercial and other aircraft so that they can be protected.

In one embodiment, the laser and the head are aligned to the optical bench using bushings and pins to accurately locate the devices on the optical bench. Note that for precision alignment, the location of the pins and the bushings are to tenths of thousands of an inch, thus to assure repeatability.

In summary, an integrated pod optical bench design is used to mount a laser and a directed infrared countermeasure head to an aircraft in which the optical bench is kinomatically mounted having two rigid points of connection to the aircraft's airframe and a stiff but flexible mount to isolate the optical bench from thermal stresses due to differing thermal co-efficient of expansion between the air frame and the optical bench.

BRIEF DESCRIPTION OF THE DRAWINGS

These and other features of the subject invention will be better understood in connection with the Detailed Description in conjunction with the Drawings of which.

DETAILED DESCRIPTION OF THE PREFERRED EMBODIMENT

Figure 1:
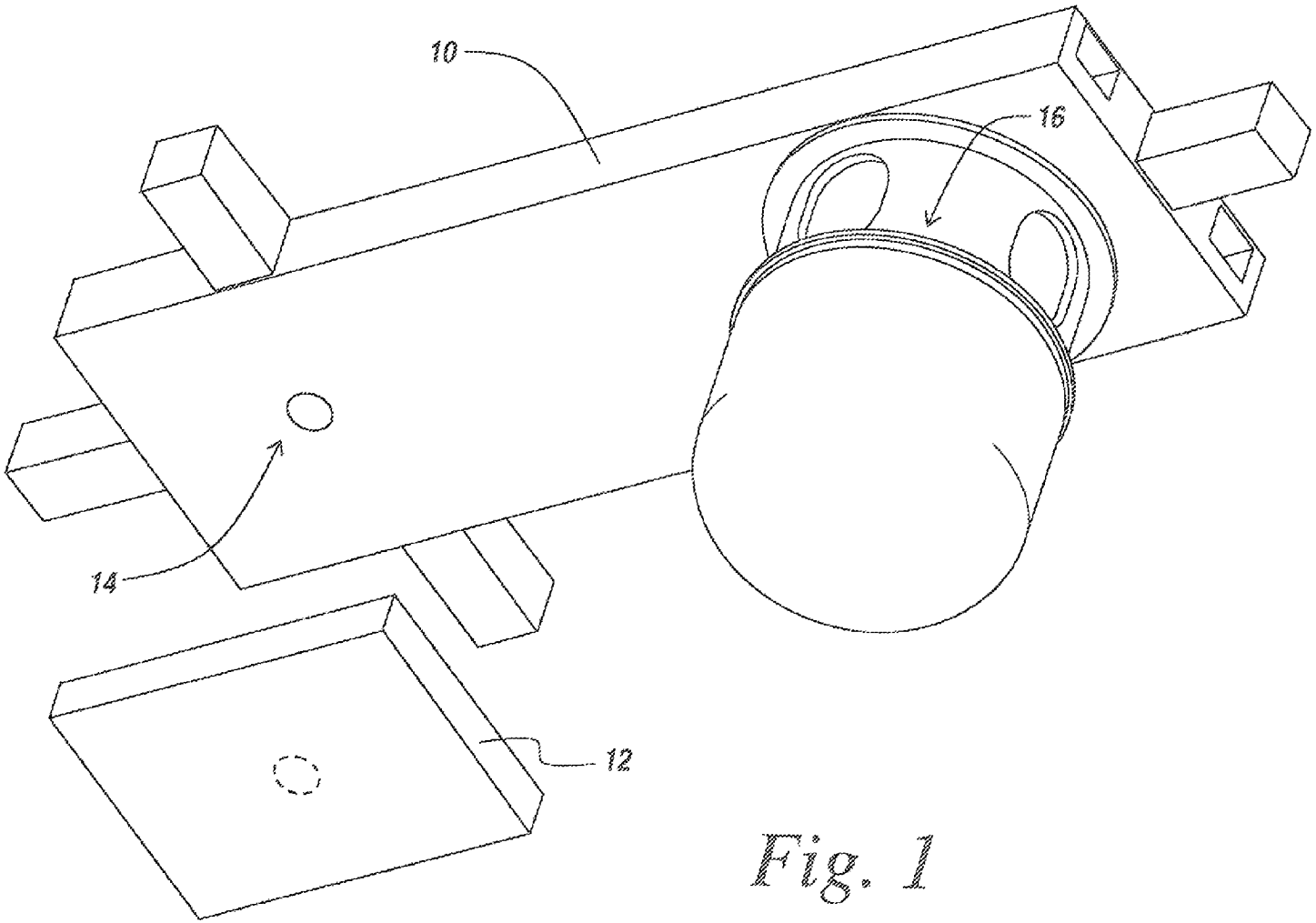
FIG. 1 is a diagrammatic illustration of the subject optical bench/laser/directed infrared countermeasure head assembly illustrating the internal optical path from the laser to the head.

Referring now to FIG. 1, an integrated pod optical bench design is shown in which an optical bench 10 carries a high energy laser 12 positioned over an optical channel orifice 14 which introduces light from the laser through an internal channel 18 to an infrared countermeasure head 16, with the light going from the laser through orifice 14 where it is re-directed laterally as illustrated at 18 and is then re-directed up into head 16.

Figure 2:
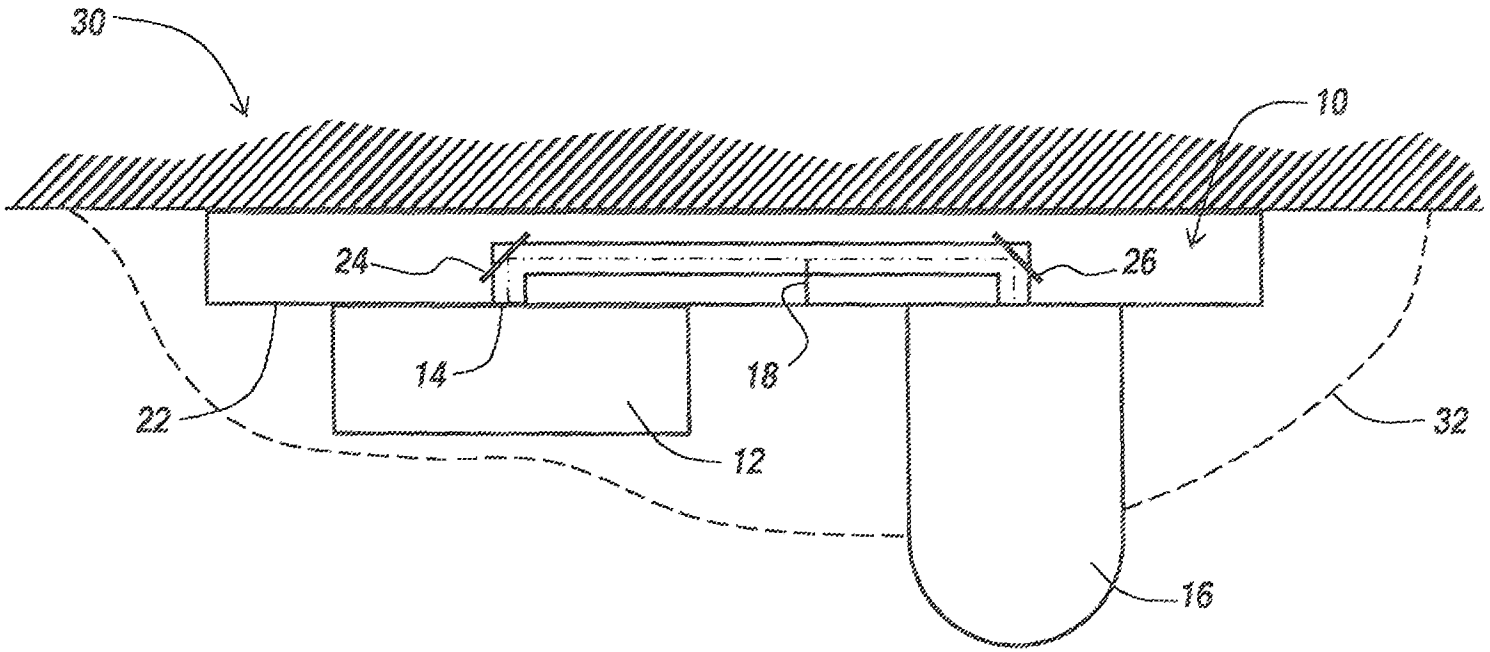
FIG. 2 is a diagrammatic illustration of the optical path from the laser to the directed infrared countermeasure head through a channel in the optical bench which re-directs light from the laser through the optical bench to the head.

Referring to FIG. 2, in diagrammatic form, laser 12 is affixed to horizontal surface 22 of optical bench 10, such that the beam from the laser enters orifice 14 where it is re-directed by mirror 24 down the length of channel 18, where it is again re-directed orthogonally by mirror 24 into the base of head 16.

It is this optical bench with its two components that is bolted to air frame 30 which constitutes a portion of the underside of the aircraft. A pod shown in dotted outline 32 shrouds the equipment to provide a conformal path at the underside of the aircraft.

As mentioned hereinbefore, it is a prime concern that the optical bench not bend, bow or otherwise become distorted during thermal cycling in which there is a difference in thermal co-efficient of expansion between the optical bench and the air frame.

Figure 3:
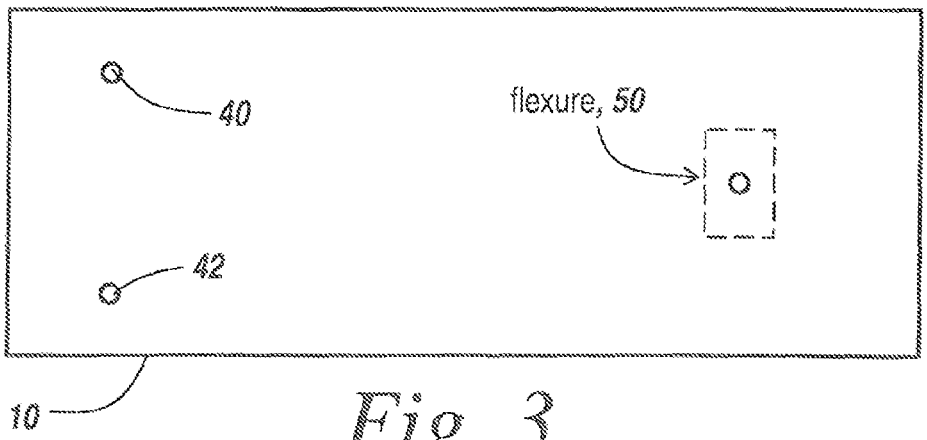
FIG. 3 is a diagrammatic illustration of the kinematic three-point system for mounting the optical bench to the aircraft airframe involving two rigid bolts and a stiff but flexible mount at the opposite end of the optical bench to provide a three-point suspension system.

In order to provide the subject kinematic mount for the optical bench so as to eliminate the possibility of any flexure or bending and referring to FIG. 3, optical bench 10 is secured to the air frame using two rigid bolts 40 and 42 at one end of the optical bench and flexure 50 at the opposite end of the optical bench. The flexure is actually a stiff but flexible pivot which is secured at one portion to the air frame and another portion to the optical bench.

Figure 4:
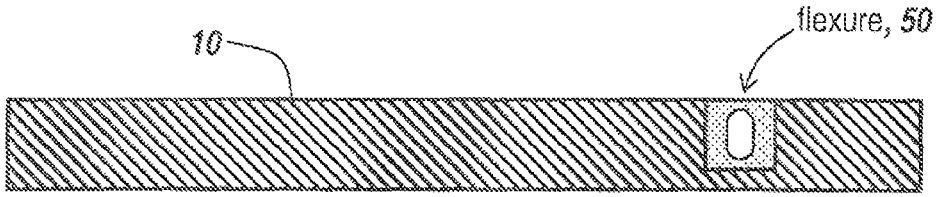
FIG. 4 is a diagrammatic illustration of the stiff but flexible mounting apparatus called a flexure for one of the three-point suspension points.

Referring to FIG. 4, flexure 50 is an apertured rectilinear structure embedded into optical bench 10 and in one embodiment has an elliptical cross-section as illustrated.

Figure 5:
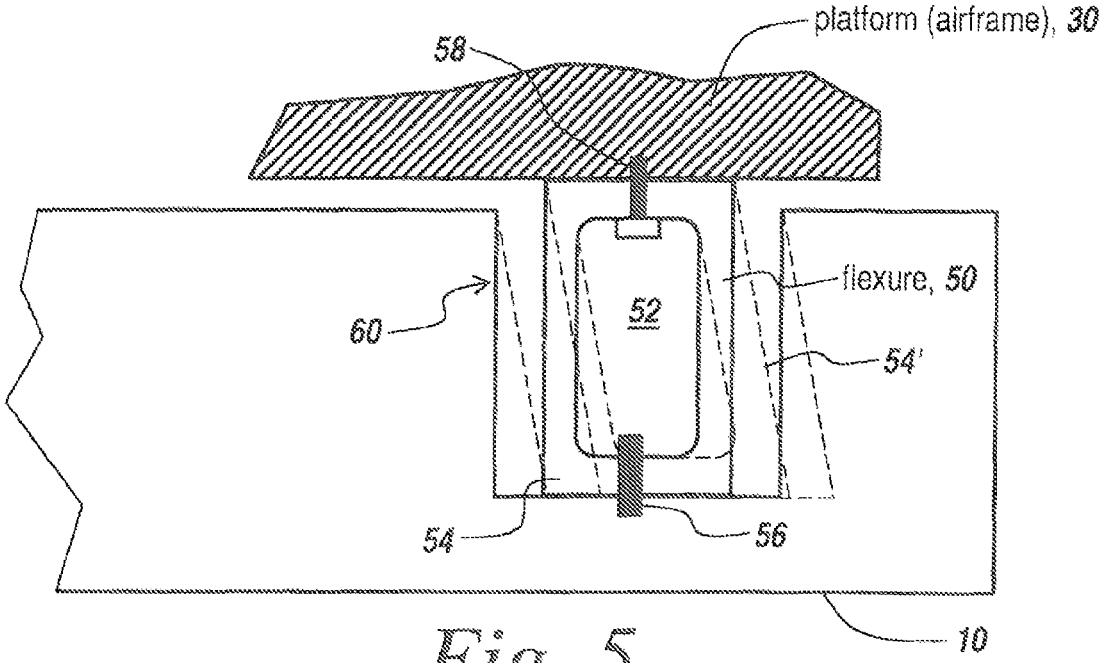
FIG. 5 is a diagrammatic illustration of the flexure showing an oval-shaped or elliptical ring which can flex as illustrated by the dotted lines.

Referring to FIG. 5, it can be seen that flexure 50 has an elliptical aperture or hole 52 in a rectilinear ring-like structure 54, with the structure 54 being affixed to the optical bench 10 by a bolt 56, whereas the diametric opposite side of flexure 50 is affixed to the air frame platform 30 with a bolt 58. Flexure 50 is provided in a cavity 60 in optical bench 10 in a loose fit such that any relative motion between the air frame platform and the optical bench is accommodated by distortion or flexing of flexure 50 as illustrated by dotted outline 54'. Thus, it can be seen that any relative movement between the air frame and the optical bench is accommodated by flexure 50, such that there is no flexing, bowing or movement of the optical bench during thermal cycling.

Figure 6:
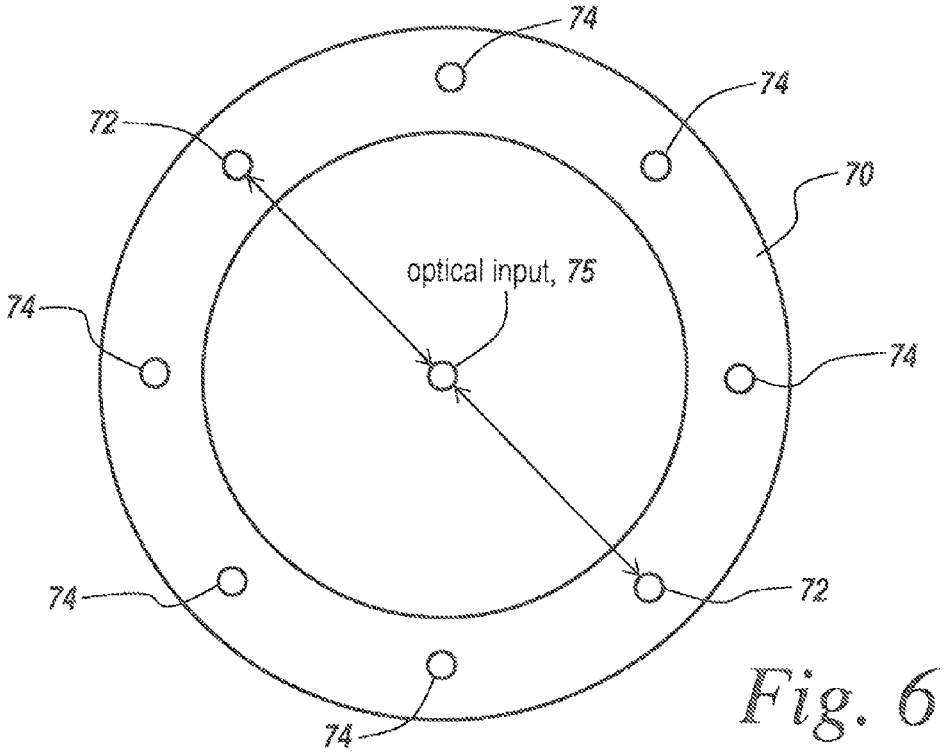
FIG. 6 is a diagrammatic illustration of a pin and bushing assembly for the directed infrared countermeasure head showing locating pins relative to an optical input, and rigid bolts which bolt the head to the optical bench.

For repeatable mounting of the various components and referring to FIG. 6, a flange 70 is provided on head 16 which is located on the optical bench through the utilization of locator pins 72 so as to locate the optical input 74 precisely at the aperture at one end of optical path 18. Here, bolts 74 are used to secure the flange of the bench with its optical centerline centered upon the optical input 75 due to the positioning of the pins in bushings within the optical bench.

Figure 7:
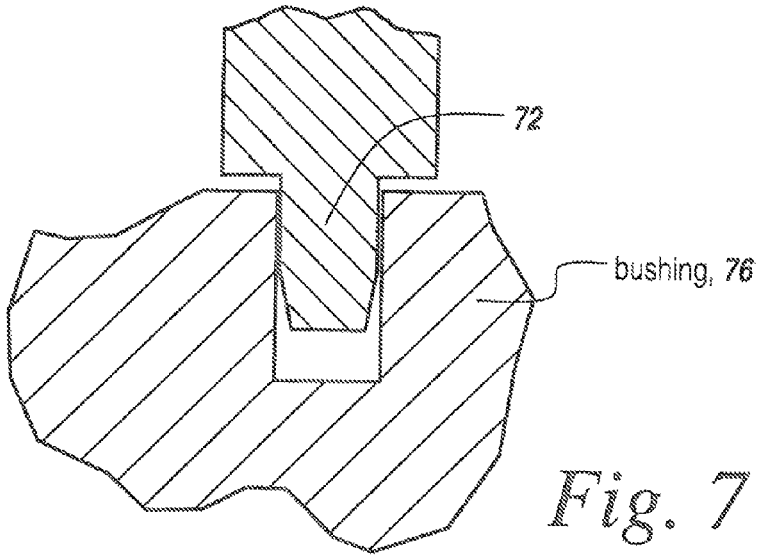
FIG. 7 is a cross-sectional view of a portion of the optical bench having a bushing into which is inserted one of the locator pins of FIG. 6; and, FIG. 8 is a diagrammatic illustration of the utilization of precision pins to locate the laser housing to the optical bench.

Referring to FIG. 7, a bushing 76 is precisely located in the optical bench with the DIRCM head pin 72 press fit into bushing 76 to locate the head with respect to the optical bench, and therefore maintain original optical alignment.

Figure 8:
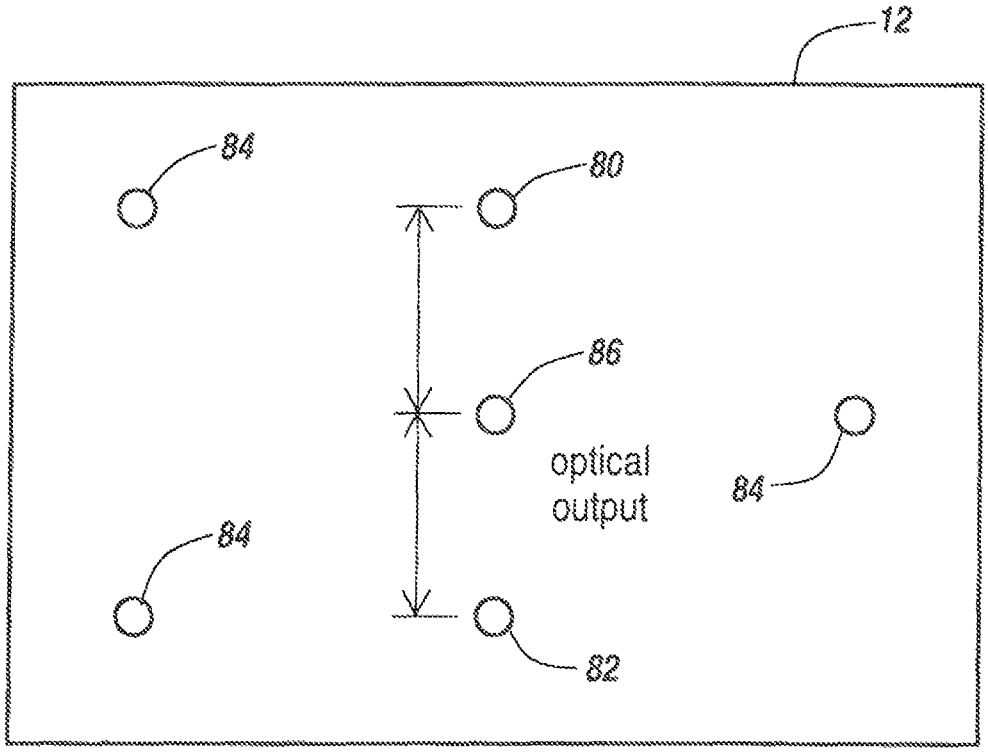

With respect to the laser, laser 12 as illustrated in FIG. 8 is positioned on the optical bench by two locator pins, here shown at 80 and 82 on the top side of the laser housing so as to position the laser output 86 directly at aperture 14.

Once aligned with the pins, the laser itself is held to the optical bench through bolt 84 to secure the laser to the optical bench, with the alignment being assured by the locator pins. As before, the locator pins go into precision bushings on the optical bench, with the locator pins being precisely positioned with respect to the optical output of the laser and aperture 14 (not shown in this figure) to repeatably locate the high energy laser with respect to the optical bench.

In summary, what is provided is an integrated optical bench for mounting a laser and infrared countermeasure head on an optical bench, with the alignment between the two units being preserved due to the rigidity of the optical bench and the mounting of the optical bench to the aircraft air frame using a kinematic mount, in one embodiment including a three-point mount in which two of the three points use rigid bolts and in which the third point spaced from these two points is a stiff but flexible mount involving a flexure that has a stiffness less still than the stiffness of the optical bench.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of eliminating bowing or bending of an optical bench used to mount a laser and a directed infrared countermeasure head side by side caused by differences in the thermal coefficient of expansion between the optical bench and an airframe to which it is attached, comprising the steps of:

providing the optical bench with a kinematic support in which one end of the optical bench is rigidly secured to the airframe and in which an opposite end of the optical bench is secured to the airframe using a stiff but flexible coupling, whereby movement between the airframe and the optical bench is taken up in the stiff but flexible coupling, thus to prevent bending of the optical bench during thermal stressing; and providing an integral optical path between the laser and the head in the optical bench.

2. The method of claim 1, wherein said kinematic mounting includes a three-point mounting system in which two of the points rigidly mount an end of the optical bench to the airframe and in which an opposed end of the optical bench is secured to the airframe utilizing a stiff but flexible coupling.

3. The method of claim 2, wherein the stiff but flexible coupling is less stiff than the optical bench, but is stiff enough to accommodate environmental loading.

4. The method of claim 2, wherein the stiff but flexible coupling includes an apertured element having stiff but flexible sidewalls and in which the element is secured between the airframe and the optical bench at opposed ends thereof by rigid fastners.

5. The method of claim 4, wherein the apertured element has one end thereof disposed in a larger aperture in the optical bench such that deformation of the element during thermal stressing is accommodated by the larger aperture.

6. A method of providing ease of maintenance in a directed infrared countermeasure system employing a laser and a directed infrared countermeasure head mounted to an aircraft airframe, comprising the steps of, side-by-side mounting the laser and the head on an optical bench secured to the airframe utilizing a kinematic mount;

providing an integral optical path between the laser and the head in the optical bench; and, releasably attaching the laser and the head to the optical bench utilizing a positioning pin and bushing assembly to maintain the alignment of the respective laser and head to the optical path when the laser and the head are located on the optical bench.

7. The method of claim 6, wherein the kinematic mount includes a three-point mount, with two of the points rigidly mounting an end of the optical bench to airframe, and a stiff but flexible mount at an opposite end of the optical bench between the optical bench and the airframe.

* * * * *